United States Patent [19]

Johnson et al.

[11] Patent Number: 4,649,378

[45] Date of Patent: Mar. 10, 1987

[54] BINARY CHARACTER GENERATOR FOR INTERLACED CRT DISPLAY

[75] Inventors: Michael J. Johnson, Phoenix, Ariz.; William R. Hancock, Bernalillo, N. Mex.

[73] Assignee: Sperry Corporation, New York, N.Y.

[21] Appl. No.: 553,224

[22] Filed: Nov. 18, 1983

[51] Int. Cl.[4] ..... G09G 1/06

[52] U.S. Cl. ..... 340/728; 340/723; 340/733; 340/744

[58] Field of Search ..... 340/723, 728, 731, 744, 340/747, 748, 732, 733; 358/242, 152

[56] References Cited

U.S. PATENT DOCUMENTS 4,119,954 10/1978 Seitz et al. ..... 340/728
4,354,186 10/1982 Groothuis ..... 340/728

FOREIGN PATENT DOCUMENTS 2640759 3/1978 Fed. Rep. of Germany ..... 340/728
0022725 2/1979 Japan ..... 340/728
0056247 4/1980 Japan ..... 340/723

*Primary Examiner*—Gerald L. Brigance

*Assistant Examiner*—Jeffery Brier

[57] ABSTRACT

An apparatus for flicker reduction and increased writing speed into image memory in a CRT display having an interlaced scan with masking of low priority symbols. The apparatus expands or duplicates adjacent picture elements to provide redundant illumination for alternate fields, thereby providing at least two adjacent illuminated picture elements proximate to a masking image to reduce flickering during the writing of alternate fields. Writing into a single memory location commands illumination of a plurality of adjacent pixels, thereby reducing image memory writing time. The apparatus utilizes an image memory wherein video bit signals are written into only storage locations whose binary x coordinate has a predetermined first digit, and whose binary y coordinate has a predetermined first digit. Signals in storage locations whose addresses correspond to picture elements $P_{I,J}$, $P_{I-1,J}$, $P_{I-1,J+1}$, and $P_{I,J+1}$ are read from the image memory, and a Boolean OR sum signal is generated therefrom which is converted to an analog signal. The picture element $P_{I,J}$ is illuminated in response to an analog signal representing the Boolean OR sum signal 1.

17 Claims, 8 Drawing Figures

BINARY CHARACTER GENERATOR FOR INTERLACED CRT DISPLAY

The U.S. Government has certain rights in this invention pursuant to Contract No. F33657-82-C-2038 awarded by the Department of the Airforce.

BACKGROUND OF THE INVENTION

1. Field of the Invention

The present invention relates generally to CRT displays, and more particularly to the expansion of illuminated picture elements therein in order to increase writing speed and eliminate flicker resulting from line pair destruction by higher priority symbols.

2. Description of the Prior Art

Lines written on a CRT display comprise discrete picture elements. Each picture element is either illuminated or not. A line is written, picture element by picture element, from left to right. The entire set of lines written on a CRT display, denoted a frame, comprises two fields. The first field comprises the odd numbered lines which are written from the top to the bottom of the CRT display. The second field comprises the even numbered lines which are also written, after the entire first field has been written, from the top to the bottom of the CRT display. Each of the two fields may be written in one-sixtieth of a second, providing a frame in one-thirtieth of a second. The picture information written on the CRT display is read from an image memory. The image memory comprises a number of addressable storage locations, which for the purposes of this invention, are herein termed "addresses", each of which contains a "1" or a "0" bit. A one-to-one correspondence exists between the addresses in the image memory and the picture elements in the CRT display. A "1" read from an address in the image memory produces illumination of the corresponding picture element in the CRT display. A "0" read from an address in the image memory engenders no illumination of the corresponding picture element in the CRT display.

When a field is written in a relatively slow time, such as one-thirtieth of a second, illuminated picture elements on a given line create a flicker which is disconcerting to a viewer. Flickering, it has been found, can be eliminated by duplicating the illuminated picture elements on an adjacent line. For example, referring to FIG. 1, a line 12 written in one-sixtieth of a second on a CRT display utilizing a binary character generator comprises illuminated picture elements 13, 14, and 15. A viewer perceives the illuminated picture elements 13, 14, and 15 to flicker. The phenomenon is remedied by duplicating the illuminated picture elements 13, 14, and 15 with, respectively, illuminated picture elements 16, 17, and 18 on an adjacent line 19. When the line 12 is written in one field and thereafter the adjacent replica line 19 is written in another field, the viewer does not experience flickering of the picture elements 13, 14, and 15.

Moving symbols in CRT displays possess various priority levels. Such symbols are surrounded by a mask, an invisible rectangle, which erases symbols of lower priority. In this fashion, higher priority symbols are precluded from merging with lower priority ones. However, the obliteration of a portion of a lower priority symbol by a higher priority one can produce flickering, by destroying duplicated illuminated picture elements. Referring to FIG. 2, a lower priority symbol 20 comprises illuminated picture elements 21 and 22 on a line 23 in one field, and illuminated picture elements 24 and 25 on an adjacent line 26 in the other field. As indicated above, the illuminated picture elements 24 and 25 duplicate, respectively, the illuminated picture elements 21 and 22 to prevent flickering. A higher priority symbol 28 comprises an illuminated picture element 29 on a line 30 in one field, and a duplicate illuminated picture element 31 on an adjacent line 32, in the other field. A mask 34 extends three lines above, and surrounds the higher priority symbol 28. Referring to FIG. 3, the higher priority symbol 28 may move upward such that the mask 34 erases the duplicate illuminated picture elements 24 and 25. With the elimination of the duplicate illuminated picture elements 24 and 25, the remaining illuminated picture elements 21 and 22 flicker.

Thus, there is a need for an apparatus, utilized with a CRT display wherein lines are written relatively slowly, for preventing disconcerting flickering on the display resulting from the erasure of duplicate illuminated picture elements by higher priority symbols.

SUMMARY OF THE INVENTION

The present invention entails an apparatus for expanding illuminated picture elements in video displays. The apparatus comprises a video display having a matrix of picture elements, $P_{X,Y}$, and having means for illuminating the picture elements in response to applied signals. A means for generating coordinates, for providing signals representing the coordinates, and for synchronizing the illuminating means with the generated coordinates is coupled to the video display. A memory is utilized which comprises addresses corresponding to the picture elements. Each of the addresses is identified by an x and a y binary coordinate, and video bit signals are stored only in addresses whose x coordinate has a predetermined first binary digit, and whose y coordinate has a predetermined first binary digit. The apparatus further comprises a means, responsive to a signal from the coordinate generating means representing a generated coordinate $_{I,J}$, for reading the addresses corresponding to picture elements $P_{I,J}$, $P_{I-1,J}$, $P_{I-1,J+1}$, and $P_{I,J+1}$. A means for generating the Boolean OR sum signal from the signals read from the addresses is coupled to the address reading means. The Boolean OR sum signal is transformed to an analog signal by a digital to analog converter which is coupled to the video display. The picture element $P_{I,J}$ is illuminated by the illuminating means of the video display in response to an analog signal representing a Boolean OR sum signal of one, and is unilluminated by the illuminating means in response to an analog signal representing a Boolean OR sum signal of zero.

In a preferred embodiment of the invention the address reading means comprises a first shift register, having two compartments, for loading in parallel with video bit signals from addresses corresponding to the picture elements $P_{I,J}$ and $P_{I-1,J}$; and, comprises a second shift register, having two compartments, for loading in parallel with video bit signals from addresses corresponding to the picture elements $P_{I,J+1}$ and $P_{I-1,J+1}$. A first delay, preferably comprising a shift register, is coupled to the first shift register. A second delay, preferably comprising a D type flip-flop, is coupled to the first delay; and a third delay, preferably comprising a D type flip-flop, is coupled to the second shift register.

By expanding illuminated picture elements, the present invention increases writing speed into image memory by requiring storage of only a portion of the addresses of the picture elements which are to be illuminated and eliminates disconcerting flickering.

BRIEF DESCRIPTION OF THE DRAWINGS

Identical numerals in different Figures represent identical elements.

DESCRIPTION OF THE PREFERRED EMBODIMENTS

Figure 1:
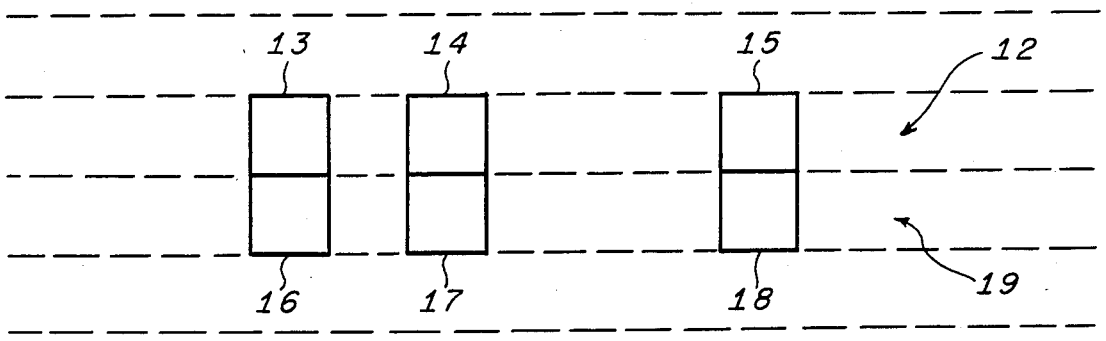
FIG. 1 is a schematic diagram illustrating duplication of illuminated picture elements in CRT displays in order to eliminate flickering.
Figure 3:
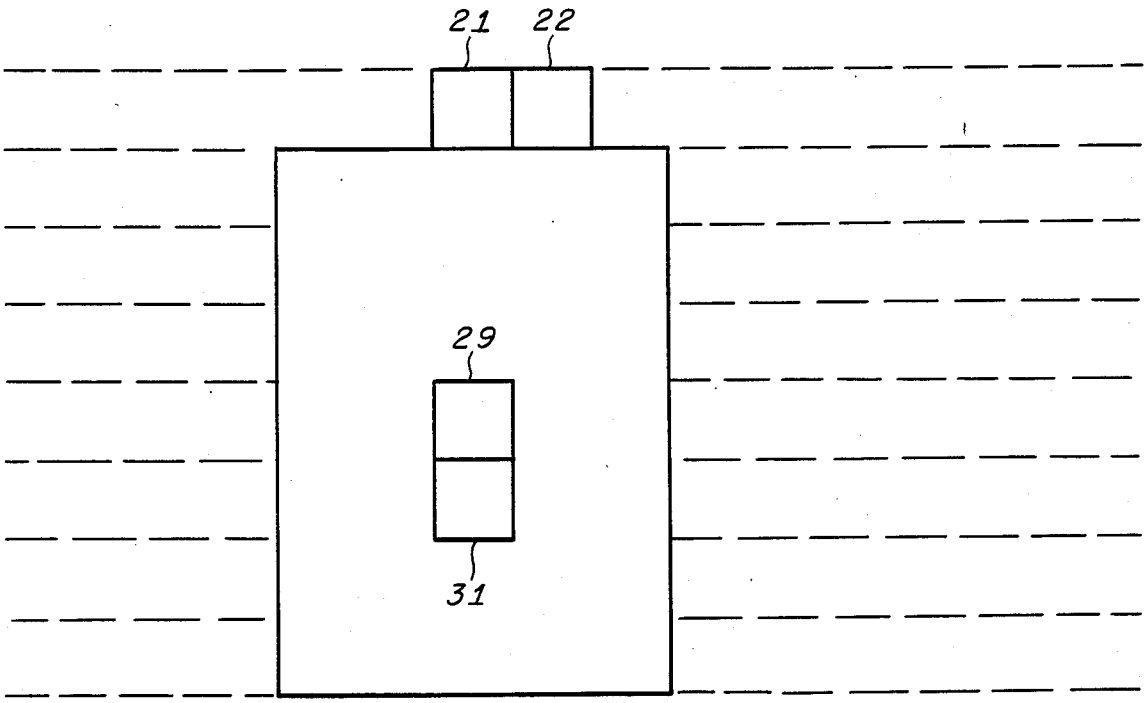
FIG. 3 is a schematic diagram illustrating the obliteration of duplicate illuminated picture elements of the lower priority symbol by the black mask of the higher priority symbol.
Figure 2:
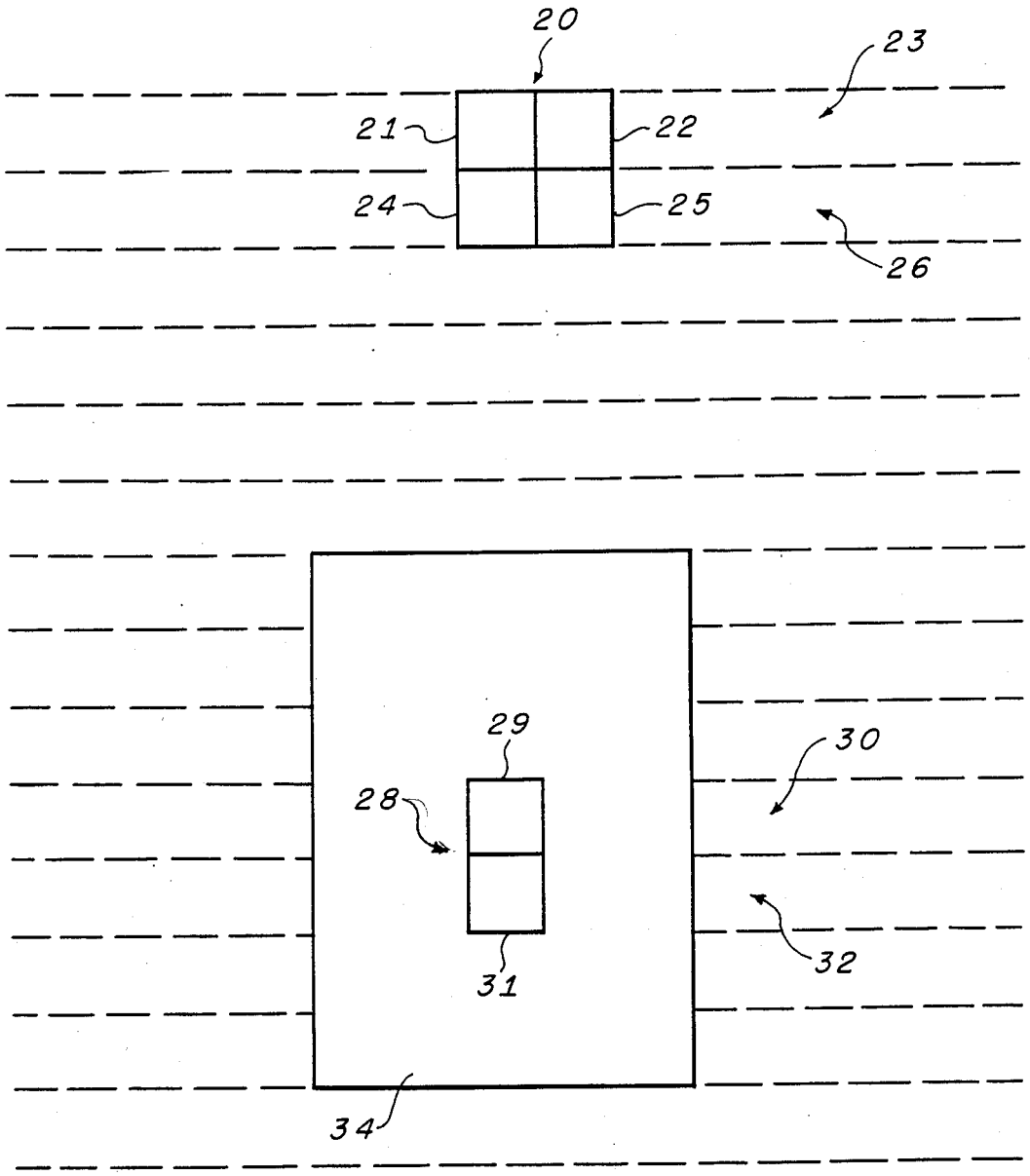
FIG. 2 is a schematic diagram of a higher priority symbol surrounded by a black mask, and a lower priority symbol in a CRT display.

The present invention entails an apparatus for expanding illuminated picture elements in a CRT display wherein lines are written relatively slowly into image memory. Such expansion increases writing speed into image memory by requiring storage of only a portion of the addresses of the picture elements which are to be illuminated, and prevents flickering resulting from the erasure of interlaced illuminated picture elements by the mask of a higher priority symbol.

An image memory contains a number of addresses which are designated by x and y coordinates. The coordinates are in binary notation. In the present invention, video bit signals for a video character are written in addresses in the image memory such that the picture elements on a CRT display corresponding to these addresses are separated on a given line by one picture element, and occupy lines which are separated by one picture element. This is achieved by writing video bit signals into only addresses whose x coordinate possesses a fixed first binary digit, and whose y coordinate possesses a fixed first binary digit. For example, to generate spaces between picture elements within a line, and spaces between lines on the CRT display, the corresponding addresses utilized in the image memory may be chosen to possess an x coordinate whose first digit is 0, and to possess a y coordinate whose first digit is 1. Any video character may possess any x, y combination of 1 and 0. Assuming that the memory comprises an eight by eight matrix of addresses, the x coordinate available to a given character of the addresses varies from 000 to 111, and the y coordinate available to a given character varies from 000 to 111. Choosing only those addresses having an x coordinate whose first binary digit is 0, and having a y coordinate whose first binary digit is 1 results in addresses available to a given character:

| | | | |
|---|---|---|---|
| (000,001)=(0,1) | (010,001)=(2,1) | (100,001)=(4,1) | (110,001)=(6,1) |
| (000,011)=(0,3) | (010,011)=(2,3) | (100,011)=(4,3) | (110,011)=(6,3) |
| (000,101)=(0,5) | (010,101)=(2,5) | (100,101)=(4,5) | (110,101)=(6,5) |
| (000,111)=(0,7) | (010,111)=(2,7) | (100,111)=(4,7) | (110,111)=(6,7) |

In this fashion, every other address may be selected in a given row and every other row may be selected. Video bit signals for the given character may be written into only these addresses in the image memory. By holding the first binary digit of both the x and y coordinates of the addresses fixed, such an alternating pattern of addresses may be generated. The invention entails writing picture information into such selected addresses in the image memory, and expanding the written information so that no gaps appear on the CRT.

As indicated in the description of the prior art, to prevent flickering an illuminated picture element must be duplicated below on the next line of the CRT display. When picture information is written into the addresses in the image memory in the alternating fashion described above, a duplicate illuminated picture element would appear on the CRT display one line below the original illuminated pictue element. To prevent flickering resulting from an erasure, by the mask of a higher priority symbol, each illuminated picture element on the CRT display is duplicated on the vacant line immediately therebelow.

In this fashion, each illuminated picture element always possesses at least one flicker-eliminating duplicate. For example, referring to FIG. 4, a higher priority symbol 40, comprising "written into memory" and illuminated picture element 41 and duplicate illuminated picture elements 42, 43 and 44, is surrounded by a black mask 45. The black mask 45 comprises picture elements 46*a* through 46*f* on a line 46, picture elements 47*a* through 47*f* on a line 47, picture elements 48*a* through 48*f* on a line 48, picture elements 49*a* through 49*d* on a line 49, picture elements 50*a* through 50*d* on a line 50, picture elements 51*a* through 51*f* on a line 51, and picture elements 52*a* through 52*f* on a line 52. A lower priority symbol 53 comprises written into memory and illuminated picture element 54 and its respective duplicates 55, 56 and 57 generated by the invention.

Symbols on the CRT display, comprising picture elements corresponding to the selected addresses in the image memory, can occupy any of the interlacing lines comprising the picture. Accordingly, vertical movement of symbols entails one line at a time but is not restricted to such.

Figure 4:
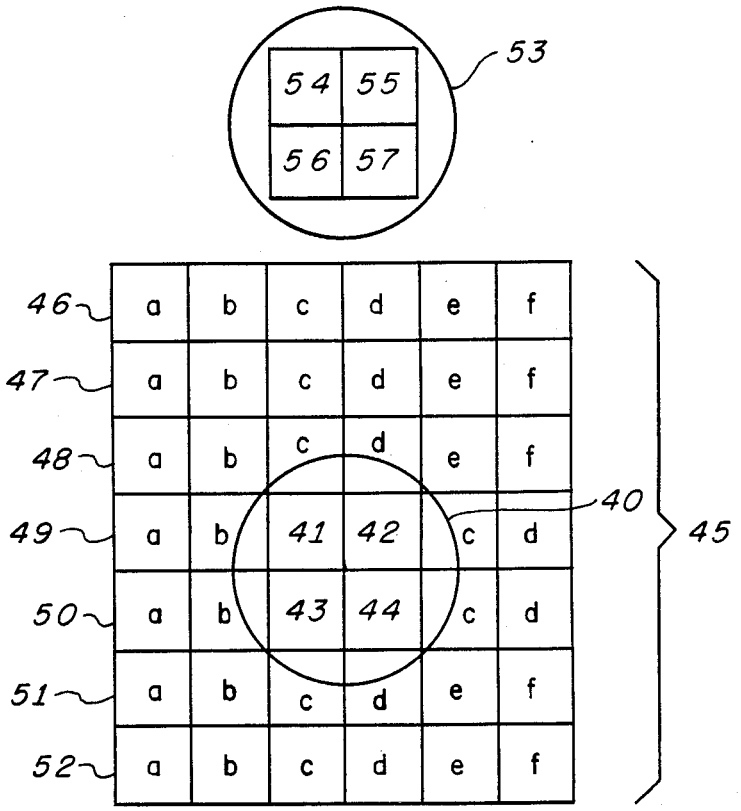
FIG. 4 is a schematic diagram of a higher priority symbol surrounded by a black mask, and a lower priority symbol written on a CRT display in accordance with the present invention.

Thus, if the higher priority symbol 40 moves upward, its second motion results in the picture elements 46*d* and 46*e* of the black mask 45 intersecting, respectively, the duplicate illuminated picture elements 56 and 57 in FIG. 4. Were it not for the picture element expansion about element 54, the picture elements 56 and 57 would produce flickering.

This flickering is eliminated by duplicate illuminated picture elements 56 and 57.

Referring again to FIG. 4, the illuminated picture element 54 is further expanded into adjacent illuminated picture elements 55 and 57. Such horizontal expansions do not affect flickering, but serve to double the speed of picture generation. Vertical expansions using pels 56 and 57 serve to avoid flicker and to double the writing speed for a net speed increase of 2 horizontally by 2 vertically equals 4 overall.

Figure 5:
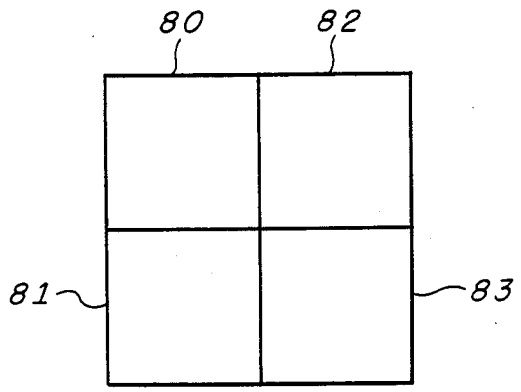
FIG. 5 is a schematic diagram illustrating expansion of an arbitrary illuminated picture element in accordance with the present invention.
Figure 6:
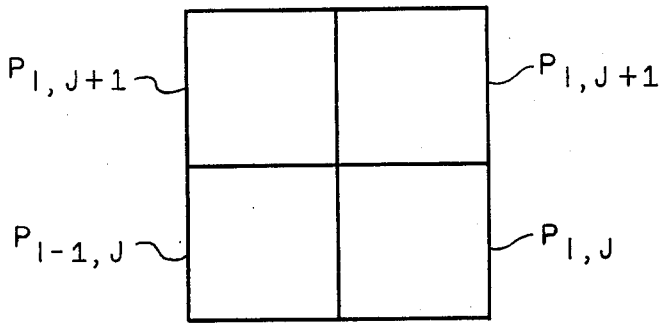
FIG. 6 is a schematic diagram of the picture elements whose memory address contents determine the illumination status of the picture element $P_{I,J}$.

Accordingly, referring to FIG. 5, to prevent flickering each illuminated picture element 80 is expanded below in an illuminated picture element 81, and to double writing speed, the illuminated picture element 80 is expanded to the right in an illuminated picture element 82, and expanded below and to the right in an illuminated picture element 83. This is accomplished by considering each picture element as the CRT display beam scans from left to right and from top to bottom. Referring to FIG. 6 denoting . . . generator is aligned as $P_{I,J}$, the adjacent picture elements $P_{I-1,J}$, $P_{I-1,J+1}$, and $P_{I,J+1}$ are considered. If there is a video bit signal of 1 in one or more of the four addresses in the image memory corresponding to these four picture elements, then the picture element $P_{I,J}$, with which the CRT beam generator is currently aligned, is illuminated by the beam. This procedure effects the expansion of each illuminated picture element in the desired fashion depicted in FIG. 5. This follows since the procedure implements the illuminated picture element expansion from the perspective of the picture element with which the CRT beam generator is currently aligned. Referring to FIGS. 5 and 6, if the CRT beam generator is currently aligned with the picture element 80 whose image memory addressed location contains a "1", then the picture element 80 is desired to be illuminated. This situation corresponds to a "1" being in the image memory addressed location of the currently aligned picture element $P_{I,J}$. $P_{I,J}$ is illuminated by the CRT beam accordingly. If the CRT beam generator is currently aligned with the picture element 82, then the picture element 82 is desired to be illuminated; since, it is an expansion of the illuminated picture element 80 to its left. This situation corresponds to a "1" being in the image memory address of the picture element $P_{I-1,J}$ which is to the left of the currently aligned picture element $P_{I,J}$. $P_{I,J}$ is illuminated accordingly. If the CRT beam generator is currently aligned with the picture element 81, then the picture element 81 is desired to be illuminated; since, it is an expansion of the illuminated picture element 80 above it. This situation corresponds to a "1" being in the image memory address of the picture element $P_{I,J+1}$ which is above the currently aligned picture element $P_{I,J}$. $P_{I,J}$ is illuminated accordingly. If the CRT beam generator is currently aligned with the picture element 83, then the picture element 83 is desired to be illuminated since it is an expansion of the illuminated picture element 80 which is above and to the left of it. This situation corresponds to a "1" being in the imge memory address of the picture element $P_{I-1,J+1}$ which is above and to the left of the currently aligned picture element $P_{I,J}$. $P_{I,J}$ is illuminated accordingly.

In this fashion, by illuminating the picture element $P_{I,J}$, with which the CRT beam generator is currently aligned, when any of the image memory addresses of the picture elements $P_{I,J}$, $P_{I-1,J}$, $P_{I-1,J+1}$, $P_{I,J+1}$ contains a 1, an illuminated picture element is expanded below, to the right, and below and to the right, as required to prevent flickering and increase writing speed.

This expansion procedure can be described mathematically. The currently aligned picture element $P_{I,J}$ is illuminated when the Boolean "OR" sum of the video bit signals in the image memory addresses of the picture elements $P_{I,J}$, $P_{I-1,J}$, $P_{I-1,J+1}$, $P_{I,J+1}$ is 1. When the Boolean "OR" sum is zero the picture element $P_{I,J}$, is unilluminated. Denoting the illumination status of the currently aligned picture element $P_{I,J}$ by IS, gives $$IS = \sum_{x=I-1,Y=J}^{I,J+1} B_{X,y},$$

where $B_{X,Y}$ is the video bit signal in the image memory address of the picture element $P_{X,}Y$.

Figure 7:
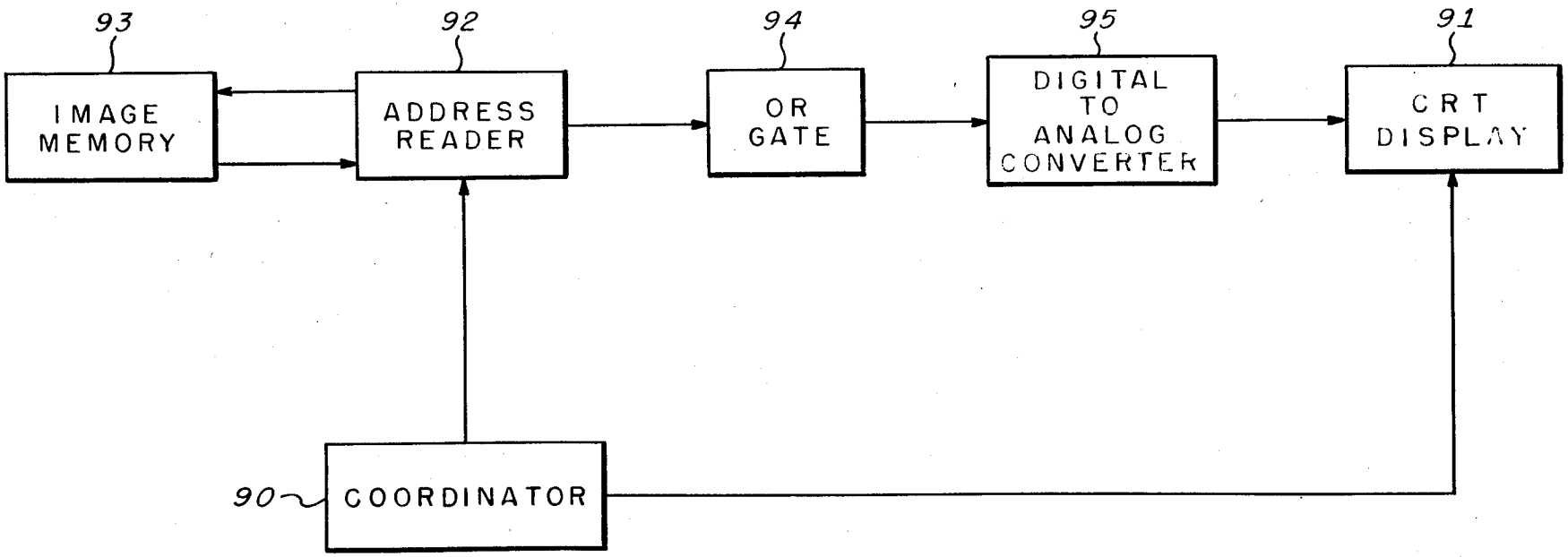
FIG. 7 is a block diagram of a preferred embodiment of the present invention.

Referring to FIG. 7, the above expansion procedure can be implemented as follows. A coordinator 90, coupled to a CRT display 91, generates coordinates and aligns the beam generator of the CRT display with picture elements corresponding to the generated coordinates. The coordinator 90 is also coupled to an address reader 92. The address reader 92 is coupled to an image memory 93. The address reader 92, in response to a signal from the coordinator 90 representing the coordinate of the picture element with which the beam generator is currently aligned, reads from the image memory 93 the video bit signals in the four addresses associated with the currently aligned picture element. That is, denoting, as before, the currently aligned picture element as $P_{I,J}$, the video bit signals $B_{I,J}$, $B_{I-1,J}$, $B_{I-1,J+1}$, and $B_{I,J+1}$ in the addresses of the image memory 93 corresponding, respectively, to the picture elements $P_{I,J}$, $P_{I-1,J}$, $P_{I-1,J+1}$, and $P_{I,J+1}$ are read from the image memory 93 by the address reader 92. These four video bit signals are conveyed by the address reader 92 to an OR gate 94. The OR gate 94 generates the Boolean OR sum, $$\sum_{X=I-1,Y=J}^{I,J+1} B_{X,Y}$$

of the four video bit signals. A digital to analog converter 95 receives the digital sum signal from the OR gate 94 and converts it to an analog signal.

The beam generator of the CRT display receives the analog signal produced by the digital to analog converter 95. In response to an analog signal corresponding to a digital signal of one, a beam is generated which illuminates the picture element $P_{I,J}$. An analog signal corresponding to a zero digital signal engenders no illumination of the picture element $P_{I,J}$.

Figure 8:
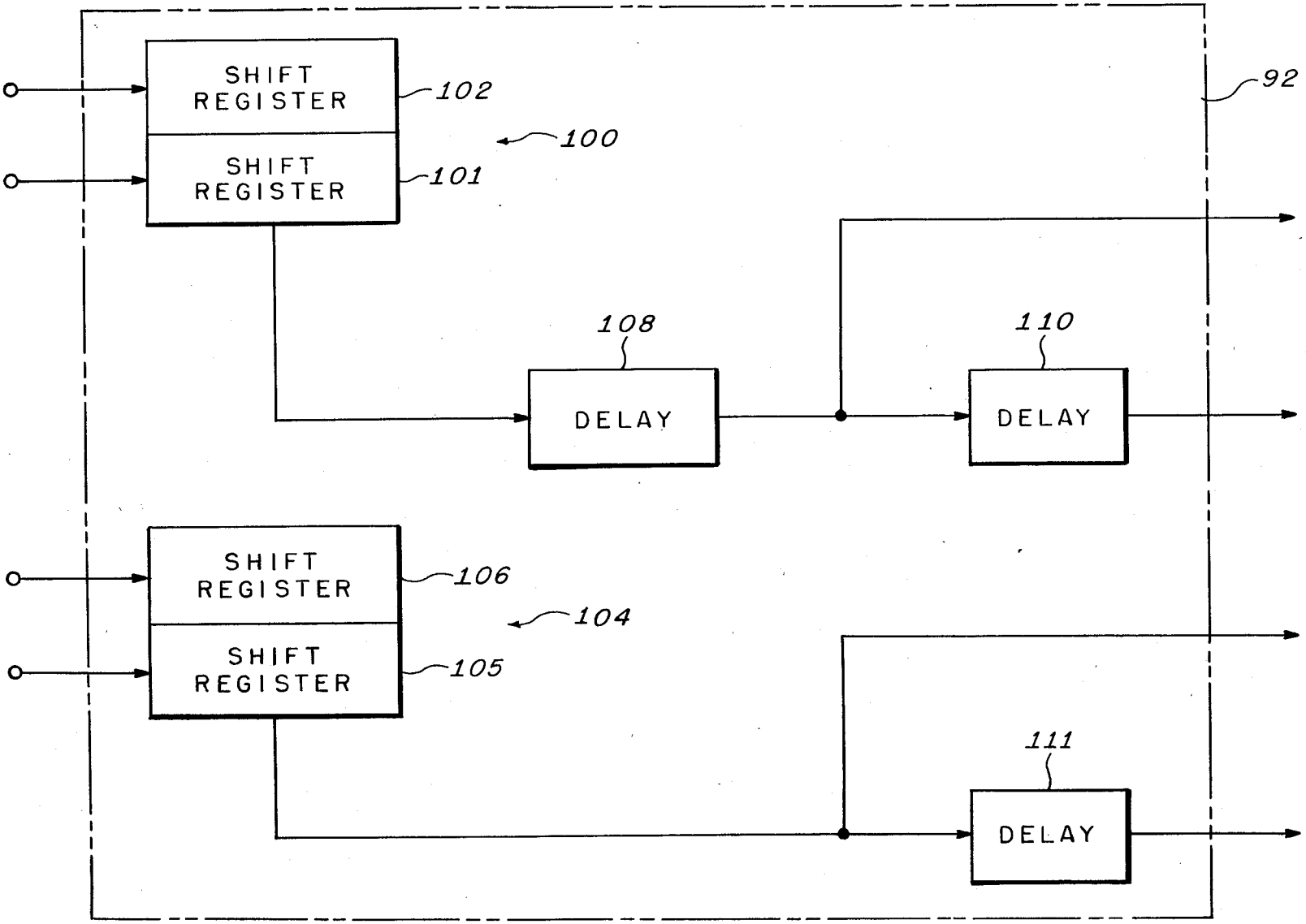
FIG. 8 is a block diagram of an address reader utilized in a preferred embodiment of the present invention.

Referring to FIG. 8, in a preferred embodiment of the invention the address reader 92 comprises shift registers and delays. A shift register 100 is loaded in parallel, with the video bit signal $B_{I-1,J}$ received by a compartment 101 and the video bit signal $B_{I,J}$ received by a compartment 102. After a delay, a shift register 104 is then loaded in parallel, with the video bit signal $B_{I-1,J+1}$ received by a compartment 105 and the video bit signal $B_{I,J+1}$ received by a compartment 106. The shift register 100 serially outputs the contents of the compartments 101 and 102. The shift register 104 serially outputs the contents of the compartments 105 and 106. The outputs of the shift register 100 are received by a delay 108 which synchronizes the outputs of the shift register 100 with those of the shift register 104. That is, the first output of the delay 108, $B_{I-1,J}$, coincides with the first output of the shift register 104, $B_{I-1,J+1}$; and, the second output of the delay 108. $B_{I,J}$, coincides with the second output of the shift register 104, $B_{I,J+1}$. Video bit signals having the same x coordinate are thereby outputted at the same time. The delay 108 preferably comprises a shift register. The first output of the delay 108, $B_{I-1,J}$ is conveyed to a delay 110. The outputting of $B_{I-1,J}$ from the dealy 110 coincides with the outputting of $B_{I,J}$ from the delay 108. Similarly, the first output of the shift register 104, $B_{I-1,J+1}$, is conveyed to a delay 111. The outputting of $B_{I-1}$, from the delay 111 coincides with the outputting of $B_{I,J+1}$ from the shift register 104. In this fashion, the four video bit signals are available for conveyance at the same time to the OR gate 94 of FIG. 7. Each of the delays 110 and 111 preferably comprises a standard D type flip-flop. If desired, the address reader 92 may be altered to accommodate more than two video bit signals from a row of addresses in the image memory. The number of compartments in the shift registers 100 and 104 are merely increased to receive the additional video bit signals. The shift register comprising the delay 108 is similarly expanded, and the delays 110 and 111 are each coupled in series with additional similar delays, also, preferably, each comprising a D type flip-flop. The various components described in FIG. 7 are well-known in the art or readily contrived by one of ordinary skill therein. The image memory 93, the OR gate 94, the digital to analog converter 95, the CRT display 91 and the coordinator 90 are conventional, well-known apparatus. One of ordinary skill in the art could readily design alternative versions of the address reader 92 described above, which would be suitable for purposes of the present invention.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. An apparatus for expanding illuminated picture elements in video display means, comprising:

a matrix of picture elements, denoted $P_{X,Y}$; and means for illuminating said picture elements in response to applied signals;

means coupled to said video display means, for generating coordinate signals representative of the position of ones of said picture elements on said display means, and for synchronizing said illuminating means with said coordinate positions;

means for storing video bit signals, comprising a plurality of addressable storage locations, ones of said locations corresponding to said ones of said picture elements, each of said locations being identified by an x and a y binary coordinate, said video bit signals being stored only in said locations at addresses whose x coordinate has a predetermined first binary digit, and whose y coordinate has a predetermined first binary digit;

means, responsive to a signal from said coordinate signal generating means representing a generated coordinate $_{I,J}$, for reading said addressable storage locations corresponding to picture elements $P_{I,J}$, $P_{I-1,J}$, $P_{I-1,J+1}$, $P_{I,J+1}$;

means coupled to said means for reading addressable storage locations, for generating a Boolean OR sum digital signal from video bit signals read from said locations corresponding to picture elements $P_{I,J}$, $P_{I-1,J}$, $P_{I-1,J+1}$, and $P_{I,J+1}$; and means, coupled to said Boolean OR sum digital signal generating means and said video display means, for generating, in response to a zero digital signal, a first analog signal, and for generating, in response to a one digital signal, a second analog signal, said picture element $P_{I,J}$ being illuminated by said illuminating means of said video display means, in response to said second analog signal, and said picture element $P_{I,J}$ being unilluminated by said illuminating means in response to said first analog signal.

2. An apparatus as in claim 1 wherein said storing means comprises an image memory.

3. An apparatus as in claim 2 wherein said video display means comprises a CRT display.

4. An apparatus as in claim 3 wherein said means for reading addressable storage locations comprises:

a first shift register comprising two compartments;
a second shift register comprising two compartments;
a first delay coupled to said first shift register;
a second delay coupled to said first delay; and
a third delay coupled to said second shift register.

5. An apparatus as in claim 4 wherein said Boolean OR sum digital signal generating means comprises a Boolean OR gate having four input terminals.

6. An apparatus as in claim 5 wherein said first delay comprises a shift register.

7. An apparatus as in claim 6 wherein said second delay comprises a D type flip-flop, and said third delay comprises a D type flip-flop.

8. An apparatus as in claim 7 wherein said converting means comprises a digital to analog converter.

9. An apparatus as in claim 1 wherein said video display means comprises a CRT display.

10. An apparatus as in claim 9 wherein said means for reading addressable storage locations comprises a first shift register comprising two compartments;
a second shift register comprising two compartments;
a first delay coupled to said first shift register;
a second delay coupled to said first delay; and
a third delay coupled to said second shift register.

11. An apparatus as in claim 10 wherein said first delay comprises a shift register.

12. An apparatus as in claim 11 wherein said second delay comprises a D type flip-flop, and said third delay comprises a D type flip-flop.

13. An apparatus as in claim 12 wherein said Boolean OR sum digital signal generating means comprises a Boolean OR gate having four input terminals.

14. An apparatus as in claim 1 wherein said means for reading addressable storage locations comprises:

a first shift register comprising two compartments;
a second shift register comprising two compartments;
a first delay coupled to said first shift register;
a second delay coupled to said first delay; and
a third delay coupled to said second shift register.

15. An apparatus as in claim 14 wherein said first delay comprises a shift register.

16. An apparatus as in claim 15 wherein said second delay comprises a D type flip-flop, and said third delay comprises a D type flip-flop.

17. An apparatus as in claim 16 wherein said Boolean OR sum digital signal generating means comprises a Boolean OR gate having four input terminals.

* * * * *